US006733938B1

(12) United States Patent
Ninomiya et al.

(10) Patent No.: US 6,733,938 B1
(45) **Date of Patent: *May 11, 2004**

(54) TONER FOR DEVELOPING ELECTROSTATIC LATENT IMAGE, TWO-COMPONENT DEVELOPER, AND IMAGE-FORMING PROCESS

(75) Inventors: Masanobu Ninomiya, Minamiashigara (JP); Yasuhiro Oya, Minamiashigara (JP); Hidekazu Yaguchi, Minamiashigara (JP); Hirokazu Hamano, Minamiashigara (JP); Haruhide Ishida, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/722,828

(22) Filed: Nov. 28, 2000

(30) Foreign Application Priority Data

Jan. 14, 2000 (JP) ..... 2000-007221

(51) Int. Cl.[7] ..... G03G 9/097; G03G 13/20

(52) U.S. Cl. ..... 430/108.1; 430/111.4; 430/124

(58) Field of Search ..... 430/111.4, 108.8, 430/108.1, 109.4, 109.3, 124, 126

(56) References Cited

U.S. PATENT DOCUMENTS 5,079,123 A * 1/1992 Nanya et al. ..... 430/109.3
5,250,382 A * 10/1993 Shimojo et al. ..... 430/110.1
6,035,171 A * 3/2000 Takaya et al. ..... 399/281
6,052,549 A * 4/2000 Shimura et al. ..... 399/176
6,094,550 A * 7/2000 Kido et al. ..... 399/103
6,459,878 B1 * 10/2002 Tomoyuki et al. ..... 399/331
6,485,878 B2 * 11/2002 Nagase et al. ..... 430/124

FOREIGN PATENT DOCUMENTS

| | | |
|---|---|---|
| JP | A-1-221758 | 9/1989 |
| JP | A-1-284863 | 11/1989 |
| JP | A-3-278067 | 12/1991 |
| JP | A-3-294866 | 12/1991 |
| JP | A-8-44110 | 2/1996 |
| JP | A-10-63035 | 3/1998 |
| JP | A-10-207126 | 8/1998 |
| JP | A-10-228131 | 8/1998 |

* cited by examiner

*Primary Examiner*—Janis L. Dote
(74) *Attorney, Agent, or Firm*—Oliff & Berridge, PLC

(57) ABSTRACT

A toner for developing an electrostatic latent image, wherein in regard to the molecular weight by GPC of the THF dissolved components of the toner, the ratio of at least $5\times10^5$ in the integral molecular weight distribution is not higher than 1% by weight, the ratio of not higher than $3\times10^3$ is not higher than 30% by weight, and the ratio $\{W(5\times10^3)/W(1\times10^5)\}$ of the ratio $\{W(5\times10^3)\}$ of not higher than $5\times10^3$ to the ratio $\{W(1\times10^5)\}$ of at least $1\times10^5$ is from 15 to 50. Also, the molecular weight by GPC of the THF dissolved components of the toner is distributed in the range of not larger than $1\times10^6$, the value of the differential molecular weight distribution of the molecular weight of $5\times10^3$ is not larger than 0.55%, and the value of the differential molecular weight distribution of the molecular weight of $1\times10^5$ is not larger than 0.15%.

20 Claims, 1 Drawing Sheet

TONER FOR DEVELOPING ELECTROSTATIC LATENT IMAGE, TWO-COMPONENT DEVELOPER, AND IMAGE-FORMING PROCESS

BACKGROUND OF THE INVENTION

1. Field of the Invention

The present invention relates to a toner for developing an electrostatic latent image (hereinafter, is sometimes simply referred to as "toner") utilizing an electrophotographic process or an electrostatic recording process, a two-component developer containing the toner, and an image-forming process using the toner.

2. Related Art

Hitherto, in the case of forming images in a copying machine, a laser beam printer, etc., a Carlson process is generally used. In an image-forming process by a black and white electrophotographic process in a conventional art, an electrostatic latent image formed on a photoreceptor by an optical method is developed with a developing step, thereafter, the developed image is transferred to a recording medium such as a recording paper, etc., in a transfer step, and then the transferred image is fixed to the recording medium such as the recording paper, etc., generally by a heat and pressure in a fixing step to obtain a black and white image.

However, in the recent electrophotographic technique, the progress of from black and white to full color has been rapidly progressed. In the color image formation by a full color electrophotographic process, the regeneration of all colors is generally carried out using four-color toners composed of three-color toners of yellow, magenta, and cyan which are the three primary colors added with a black toner. In a general full color electrophotographic process, first, an original is color-separated in yellow, magenta, cyan, and black and per each color, an electrostatic latent image is formed on a photoconductive layer. Then, a toner is held on a recording medium through a development and a transfer step. Then, the above-described steps are successively carried out plural times per each color, and while matching the positions of toner images each having each different color, the toner images each having each different color are overlapped on a same recording medium. Also, by applying one fixing process, a full color image is obtained. The point of overlapping several kinds of toner images each having a different color as described above is a large difference between the black and white electrophotographic process and the full color electrophotographic process. In the color toners used for the full color electrophotographic process, it is necessary that the toners of many colors are sufficiently mixed in the fixing process and by sufficiently mixing these multicolor toners, the color reproducibility and the transparency of an OHP image are improved, and a full color image having a high image quality can be obtained. Thus, as compared with a black toner for black and white print, it is desired that the color toners are generally formed by sharp melting low-molecular weight resin to increase the color mixing property.

In the black toner for the black and white prints of prior art, because the toner image is brought into contact with a fixing unit such as a heat roller, etc., in a heat-melt state, to prevent the occurrence of a so-called offset phenomenon that a part of the toner image attaches and transfers to the surface of the heat roller, the black toner contains therein a wax having a high crystalline property and a relatively high melting point, such as polyethylene, polypropylene, etc. In general, in the case of a high viscous toner such as the black toner for the black and white print, since the intermolecular cohesive force at heat-melting of the toner is strong, the occurrence of the offset phenomenon can be prevented by oozing out a small amount of the wax. However, when it is necessary to color by overlapping toners of two or more colors such as full color toners and to form a flat fixed image surface for giving a transparency of an OHP image, it is required to lower the viscosity of the toners and increase the heat-melting property of the toners. In this case, for obtaining a sufficient effect for the anti-offset property, it is necessary to add a large amount of wax to the toners. However, because in the case of the toners prepared by a melt-kneading/grinding method, the toners become the structures of exposing the wax onto the surfaces of the toners, whereby a large amount of the wax exposed on the surfaces of the toners causes filming to a photoreceptor and is liable to stain the carriers and the surfaces of the developing sleeve, and thus the images formed are liable to be deteriorated.

Accordingly, a method has been employed wherein usually color toners for full color do not contain wax, for the purpose of preventing the occurrence of offset phenomenon, the surface of heat-fixing roller is formed with a silicone rubber or a fluorine resin excellent in the releasing property to the toners and further a releasing liquid such as s silicone oil, etc., is supplied to the surface of the roller. The method is very effective in the point of preventing the occurrence of the offset phenomenons of toners, but there is a problem that an apparatus for supplying an offset preventing liquid becomes necessary. This is not directed to the small sizing and the light weighing of the image-forming apparatus, and also there sometimes occur the problems that the offset preventing liquid is evaporated by heating to give an unpleasant smell and the vapor of the liquid stains the inside of the apparatus.

Therefore, for the color toners for full color, a sharp melting low-molecular resin is used, and the toners contain only a small amount of a low-melting wax and can be fixed without supplying a releasing liquid to the surface of the heat-fixing roller has been investigated.

As one of the investigations, various reports have been made for controlling the molecular weight distribution of binder resins. In general, a resin having a low molecular weight has a low viscosity and is sharp melting and is useful for a low-temperature fixing and the formation of a flat fixed image, but is inferior in the anti-offset property. Also, a resin having a high molecular weight has a high viscosity and is useful for the anti-offset property but is disadvantageous for low-temperature fixing and the formation of a flat fixed image.

Thus, there are many attempts of satisfying both the low-temperature fixing property and the anti-offset property by combining a resin having a low-molecular weight if and a resin having a high-molecular weight, or by defining the molecular weight distribution. For example, as the toner defining the molecular weight distribution, there are a toner defining the value of Mw/Mn as described in Japanese Patent Laid-Open Nos. 284863/1989 and 207126/1998, a toner having the two maximum values as described in Japanese Patent Laid-Open No. 294866/1991, a toner having the three maximum values as described in Japanese Patent Laid-Open Nos. 221758/1989 and 63035/1998, a toner finely defining the ratio of a low molecular weight component and a high molecular weight component as described in Japanese Patent Laid-Open Nos. 44110/1996, 228131/1998, and 278067/1991, and the like.

Because these toners have a low fixing temperature and can improve the anti-offset property, they are sufficient for obtaining monochromatic images. However, because the toners containing a crosslinking component or a high molecular weight component of at least $1\times10^6$ as described in Japanese Patent Laid-Open Nos. 294866/1991 and 221758/1998 do not have a low melt viscosity and cannot form a flat fixed image, the transparency is bad and these toners are insufficient as full color toners.

Also, by the molecular weight distributions having a wide distribution as defined in Japanese Patent Laid-Open Nos. 284863/1989, 44110/1996, 207126/1998, and 228131/1998, the balance of the low molecular weight component and the high molecular weight component is bad and all of the low-temperature fixing property, the OHP transparency, and the flat fixed image forming performance cannot be simultaneously satisfied in sufficiently levels. That is, because the molecular weight distribution having a wide distribution contains large amounts of a low-molecular weight component and a high-molecular weight component, there are problems that the low-molecular weight component lowers the characteristics of the anti-offset property, and the high-molecular weight component lowers the low-temperature fixing property and the flat fixed image forming performance.

Also, the toner disclosed in Japanese Patent Laid-Open 63035/1998 has the peak at the region of a very low molecular weight of from 500 to 1000. Because the toner has a very large amount of a low-molecular weight component, the anti-offset property is insufficient. As a fixing method of solving the problem of the anti-offset property, a method of increasing a pressure at fixing to anchor the toner on a transfer material can be employed, but the separation traces of a member of separating the transfer material from a fixing roller appear on images and further owing to the high pressure, a line image is smashed at fixing, whereby image defects of the copy images are liable to cause.

Also, in Japanese Patent Laid-Open No. 278067/1991, a toner wherein the ratio of the molecular weight distribution of 10,000 or lower is from 55 to 80% is described, but because the toner contains a large amount of a very low-molecular component, fixing without oil is difficult.

SUMMARY OF THE INVENTION

The present invention has been made for solving the above-described problems in the techniques. That is, the present invention provides a toner for developing an electrostatic latent image which is excellent in the low-temperature fixing property, the OHP transparency, and the anti-offset property without substantially coating oil in heat roll fixing and can form a fixing image having a high glossiness, a two-component developer containing the toner, and an image-forming process using the toner.

The present invention solving the above-described problems is as follows.

That is, the 1st aspect of the invention is a toner for developing an electrostatic latent image containing a binder resin, a colorant, and a wax. In regard to the molecular weight by GPC of the THF dissolved components of the toner, the ratio of at least $5\times10^5$ in the integral molecular weight distribution is not higher than 1% by weight, the ratio of not higher than $3\times10^3$ in the integral molecular weight distribution is not higher than 30% by weight, and the ratio $\{W(5\times10^3)/W(1\times10^3)\}$ of the ratio $\{W(5\times10^3)\}$ of not higher than $5\times10^3$ in the integral molecular weight distribution to the ratio $\{W(1\times10^3)\}$ of at least $1\times10^3$ in the integral molecular weight distribution is from 15 to 50.

The 2nd aspect of the invention is also a toner for developing an electrostatic latent image containing at least a binder resin, a colorant, and a wax. The molecular weight by GPC of the THF dissolved components of the toner is distributed in the range of not larger than $1\times10^6$, the value of the differential molecular weight distribution of the molecular weight $5\times10^3$ is not larger than 0.55%, and the value of the differential molecular weight of the molecular weight $1\times10^5$ is not larger than 0.15%.

The 3rd aspect of the invention is a two-component developer containing the toner and carrier, and the toner is described in the above-described 1st or 2nd aspect.

The 4th aspect of the invention is an image-forming process including a latent image-forming step of forming an electrostatic latent image on a latent image holding member, a developing step of forming a toner image by developing the electrostatic latent image with a toner, a transfer step of transferring the toner image onto a transfer material to form a transfer image, and a fixing step of fixing the transferred image using a fixing apparatus comprising, for example, a heat roller and a press roller. The toner is that described in the aspect 1 or 2 above, the surfaces of the heat roller and the press roller are formed of a releasing resin such as, for example, a fluorine resin, and a releasing liquid is not substantially supplied to the surfaces.

Furthermore, as the invention for solving the above-described problems, the following aspects are preferred.

That is, the 5th aspect of the invention is the toner for developing the electrostatic latent image described in the 1st or 2nd aspect described above. The binder resin is composed of at least two kinds of a binder resin (A) and a binder resin (B), the weight average molecular weight (Mw) of the binder resin (A) is from 8000 to 18000, the ratio (Mw/Mn) of the weight average molecular weight (Mw) to the number average molecular weight (Mn) of the binder resin (A) is from 2 to 4, the weight average molecular weight (Mw) of the binder resin (B) is from 20,000 to 40,000, and the ratio (Mw/Mn) of the weight average molecular weight (Mw) to the number average molecular weight (Mn) of the binder resin (B) is from 3 to 5.

The 6th aspect of the invention is the toner for developing the electrostatic latent image described in one of the 1st, 2nd, and 5th aspects described above. The toner is prepared by a melt kneading method.

The 7th aspect of the invention is the toner for developing the electrostatic latent image described in one of the 1st, 2nd, 5th, and 6th aspects. The binder resin is polyester.

The 8th aspect of the invention is the toner for developing the electrostatic latent image described in one of the 1st, 2nd, 5th to 7th aspects described above. The toner is a color toner.

The 9th aspect of the invention is the toner for developing the electrostatic latent image described in one of the 1st, 2nd, 5th to 8th aspects described above. The wax has a melting point in the temperature range of from 70 to 100° C., a melt viscosity of from 1 to 200 mPa·s at 110° C., and the content thereof to the toner is from 5 to 10% by weight.

The 10th aspect of the invention is the toner for developing the electrostatic latent image described in the 1st, 2nd, 5th to 9th aspects described above. The toner contains inorganic fine particles in an amount from 1 to 10% by weight to the toner.

The $11^{th}$ aspect of the invention is the image-forming process described in the aspect 4 described above. When the toner amount on the recording paper is 0.50 mg/cm$^2$ and the glossiness (75 degree gloss) is from 40 to 60, and preferably 40 to 50.

The 12th aspect of the invention is the image-forming process described in the 4th or 11th aspect described above. The surface temperature of the heat roller and the press roller is from 150 to 180° C.

The 13th aspect of the invention is the image-forming process described in one of the 4th, 11th, and 12th aspects described above. The peripheral speed of the heat roller and the press roller is from 70 to 120 mm/second.

The 14th aspect of the invention is the image-forming process described in one of the 4th, and 11th to 13th aspects described above. The rubber hardness of the heat roller and the press roller is from 55 to 85 degrees by Asker C and the pressing force of the heat roller and the press roller is from 392 to 638N.

The 15th aspect of the invention is the image-forming process described in one of the 4th and 11th to 14th aspects described above. Each of the heat roller and the press roller has an elastic layer and a surface layer on the core surface in the order and the rubber hardness of the elastic layer is from 10 to 40 degrees by Asker C.

BRIEF DESCRIPTION OF THE DRAWINGS

Preferred embodiments of the present invention will be described in detail based on the followings, wherein.

DETAILED DESCRIPTION OF THE INVENTION

Then, the present invention is described in detail.

[Electrostatic Charge Image Developing Toner]

The toner of the 1st aspect of the invention contains at least a binder resin, a colorant, and a wax and, if necessary, contains other components. In the toner of the 1st aspect of the invention, in regard to the molecular weight by GPC of the THF dissolved components of the toner, the ratio of at least $5\times10^5$ in the integral molecular weight distribution is not higher than 1% by weight, the ratio of not higher than $3\times10^3$ in the integral molecular weight distribution is not higher than 30% by weight, and the ratio $\{W(5\times10^3)/W(1\times10^3)\}$ of the ratio $\{W(5\times10^3)\}$ of not higher than $5\times10^3$ in the integral molecular weight distribution to the ratio $\{W(1\times10^5)\}$ of at least $1\times10^5$ in the integral molecular weight distribution is from 15 to 50.

In this case, the above-described integral molecular weight is the distribution obtained by graphically representing the axis of abscissa as a molecular weight (logarithmic scale) and the axis of ordinate as a cumulative weight %.

The toner of the 2nd aspect of the invention contains at least a binder resin, a colorant, and a wax and, if necessary, contains other components. In the toner of the 2nd aspect of the invention, the molecular weight by GPC of the THF dissolved components of the toner is distributed in the range of not larger than $1\times10^6$, the value of the differential molecular weight distribution of the molecular weight $5\times10^3$ is not larger than 0.55%, and the value of the differential molecular weight of the molecular weight $1\times10^5$ is not larger than 0.15%.

In this case, the differential molecular weight distribution is the distribution obtained by graphically representing the axis of abscissa as a molecular weight (logarithmic scale) and the axis of ordinate as a weight fraction (dW/dlogM) per unit logM, wherein M represents a molecular weight and W represents a weight.

By using the toner of the 1st or 2nd aspect of the invention, images excellent in the low-temperature fixing property, the OHP transparency, and the anti-offset property without substantially coating oil in heat roll fixing can be formed.

Figure 1:
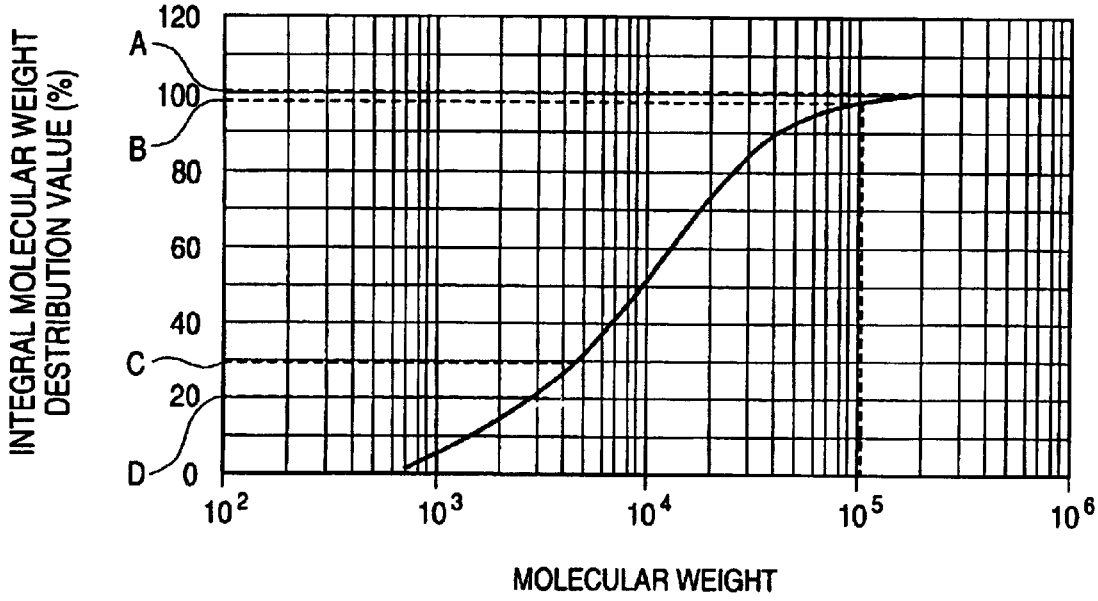
FIG. 1 is a graph showing an embodiment of the integral molecular weight distribution of the 1st aspect of the invention.

FIG. 1 shows an embodiment of the integral molecular weight distribution of the toner of the 1st aspect of the invention. As shown in FIG. 1, in the toner of the 1st aspect of the invention, in regard to the molecular weight by GPC of the THF dissolved components of the toner, the ratio $\{W(5\times10^5)=100-(A)\ \%\}$ of at least $5\times10^5$ in the integral molecular weight distribution is not higher than 1% by weight, the ratio $\{W(3\times10^3)=(D)\ \%\}$ of not higher than $3\times10^3$ in the integral molecular weight distribution is not higher than 30% by weight, and the ratio $\{W(5\times10^3)/W(1\times10^3)\}$ of the ratio $\{W(5\times10^3)=(C)\ \%\}$ of not higher than $5\times10^3$ in the integral molecular weight distribution to the ratio $\{W(1\times10^5)=100-(B)\ \%\}$ of at least $1\times10^5$ in the integral molecular weight distribution is from 15 to 50. That is, in the 1st aspect of the invention, by reducing the amount of the low-molecular weight component, the anti-offset property is improved, and further by reducing the amount of the high-molecular weight component, the low-temperature fixing property, the OHP transparency, and the flat fixed image forming performance are increased. In other words, by narrowing the molecular weight distribution and by controlling the amounts of the low-molecular weight component and the high-molecular weight component, it becomes possible to simultaneously satisfy the various characteristics required for the full color toners.

In regard to the molecular weight by GPC of the THF dissolved components of the toner of the 1st aspect of the invention, when the ratio of at least $5\times10^3$ is more than 1% by weight, the viscosity of the toner becomes greatly high, a flat fixed image surface is hard to obtain, and the OHP transparency is lowered. Also, when the ratio of not higher than $3\times10^3$ in the integral molecular weight distribution is more than 30% by weight, the anti-offset property is extremely deteriorated.

Also, in regard to the molecular weight by GPC of the THF dissolved components of the toner, even when the ratio of at least $5\times10^5$ in the integral molecular weight distribution is not higher than 1% by weight, and the ratio of not higher than $3\times10^3$ is not higher than 30% by weight, particularly when the amount of the high-molecular weight distribution is increased as the case that the ratio $\{W(5\times10^3)/W(1\times10^5)\}$ of the ratio $W(5\times10^3)$ of not higher than $5\times10^3$ in the integral molecular weight distribution to the ratio $W(1\times10^5)$ of at least $1\times10^5$ in the integral molecular weight distribution is less than 15, all the anti-offset property, the low-temperature fixing property, and the OHP transparency cannot be satisfied simultaneously in sufficient levels. This is because the high molecular weight component of at least $1\times10^3$ obstructs the low-temperature fixing property and the OHP transparency. Also, when $W(5\times10^3)/W(1\times10^3)\}$ is larger than 50, the ratio of the low-molecular component of the toner is too large, whereby the viscosity of the toner becomes too low and the anti-offset property is lowered. It is preferred that $W(5\times10^3)/W(1\times10^3)\}$ described above is from 20 to 40.

Figure 2:
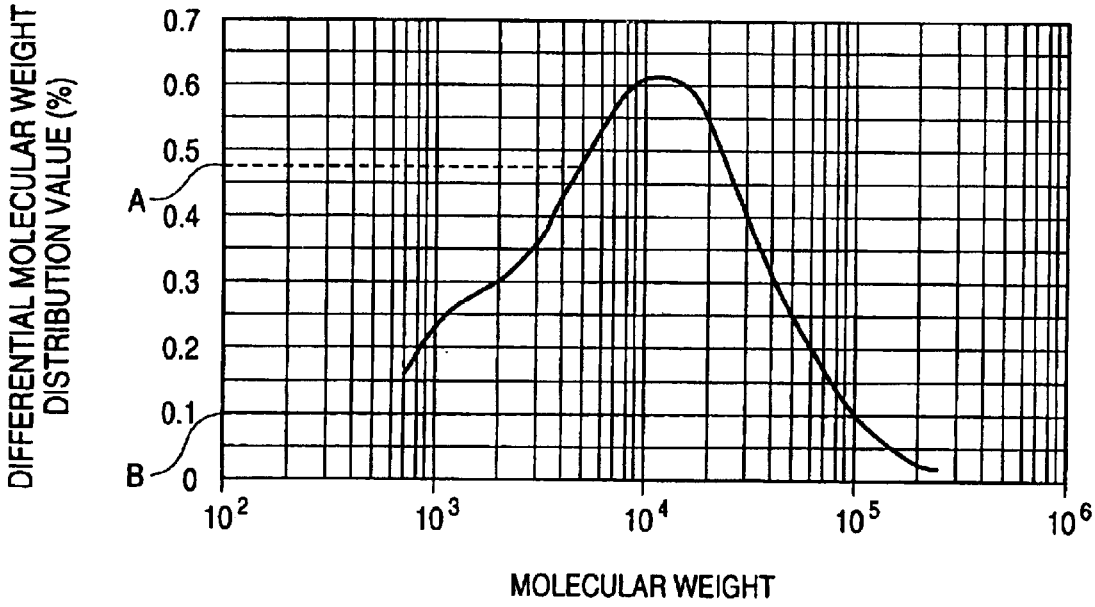
FIG. 2 is a graph showing an embodiment of the differential molecular weight of the 2nd aspect of the invention.

FIG. 2 shows an embodiment of the differential molecular weight distribution of the toner of the 2nd aspect of the invention. As shown in FIG. 2, in the toner of the 2nd aspect of the invention, the molecular weight by GPC of the THF dissolved components of the toner is distributed in the range of not larger than $1\times10^6$, the value [the value of (A) in FIG. 2] of the differential molecular weight distribution of the molecular weight $5\times10^3$ is not larger than 0.55%, and the value [the value of (B) in FIG. 2] of the differential molecular weight of the molecular weight $1\times10^5$ is not larger than 0.15%. That is, in the 2nd aspect of the invention, by reducing the amount of the low-molecular weight component, the anti-offset property is improved, and further, by reducing the amount of the high-molecular weight component, the low-temperature fixing property, the OHP transparency, and the flat fixed image forming performance are increased. In other words, by narrowing the molecular weight distribution and by controlling the amounts of the low-molecular weight component and the high-molecular weight component, it becomes possible to simultaneously satisfy the various characteristics required for the full color toners.

When the molecular weight by GPC of the THF dissolved components of the toner of the 2nd aspect of the invention is distributed in the range of exceeding $1\times10^6$, the viscosity of the toner becomes greatly high, a flat fixed image surface is hard to obtain, and the transparency of OHP is lowered. It is preferred that the molecular weight by GPC of the THF dissolved components of the toner is distributed in the range of not larger than $5\times10^6$.

Also, even when the above-described molecular weight is distributed in the range of not larger than $1\times10^6$, particularly when the value of the differential molecular weight distribution of the above-described molecular weight $1\times10^5$ is larger than 0.15%, although the toner viscosity at high temperature is lowered, the toner viscosity at low temperature is yet high, whereby low-temperature fixing becomes difficult. It is preferred that the value of the differential molecular weight distribution of the above-described molecular weight $1\times10^5$ is not larger than 0.10%.

Also, when the value of the differential molecular weight distribution of the above-described molecular weight $1\times10^5$ is larger than 0.55%, the anti-offset performance is rapidly deteriorated, whereby it becomes impossible to carry out fixing without substantially coating oil in heat roll fixing. It is preferred that the value of the differential molecular weight distribution of the above-described molecular weight $5\times10^3$ is not larger than 0.45%.

In the toners of the 1st aspect and the 2nd aspect of the invention, the shape factor SF-1 shown by following formula (1) is preferably from 130 to 160, and more preferably from 140 to 160. Also, the shape factor SF-2 of the toner shown by following formula (2) is preferably from 110 to 140, and more preferably from 120 to 140.

$$SF-1 = \frac{(\text{The maximum length of the diameter of toner particle})^2}{\text{Area of toner particle}} \times \frac{\pi}{4} \times 100 \quad (1)$$

$$SF-2 = \frac{(\text{Peripheral length of the projected image of toner particle})^2}{\text{Area of toner particle}} \times \frac{1}{4\pi} \times 100 \quad (2)$$

In the invention, the shape factor of the toner is calculated by the following measurement method. The shape factor is used as a factor of expressing the shape or form, etc., of the toner, is based on a statistic technique of an image analysis capable if quantitatively analyzing at high precision the area, the length, the form, etc., of the image cached by an optical microscope, etc., and can be measured by an image analyzer (LUZEX 5000™, manufactured by Nippon Regulator Co., Ltd.).

As is clear from the above-described formula (1), SF-1 is the numerical value obtained by multiplying the maximum length of the diameter of a toner particle by itself, dividing the value obtained by the area of the toner particle, multiplying the value obtained by $\pi/4$, and further multiplying the value obtained by 100. As the form of the toner particle is more like a sphere, SF-1 becomes nearer the value 100, while, on the contrary, as the toner particle is more slender, the value becomes larger. That is, SF-1 shows the difference between the maximum diameter and the minimum diameter of a toner particle, that is, shows a distortion. Also, as is clear from the above-described formula (2), SF-2 is the numerical value obtained by multiplying the peripheral length of the projected image of a toner particle by itself, dividing the value obtained by the area of the toner particle, multiplying the value obtained by $1/4\pi$, and further multiplying the value obtained by 100. As the form of the toner particle is more like a sphere, SF-2 becomes nearer the value 100, and as the peripheral form of the toner particle is more complicated, the value becomes larger. That is, SF-2 represents the surface area (unevenness) of the toner. When the toner is a complete sphere, SF-1=SF-2=100.

The larger the exposed area of a wax on the surface of the toner is, the better the fixing property is, which is attained when the toner becomes amorphous. On the contrary, as the toner particle is more like a sphere, that is, when SF-1 is smaller than 130 and SF-2 is smaller than 110, the exposed area of a wax on the toner surface becomes smaller and the fixing temperature width capable of fixing without causing offset becomes narrower. However, when the toner particle becomes too amorphous, for example, when SF-1 is larger than 160 and SF-2 is larger than 140, although there is no problem about fixing, an uneven developer layer forms on a development sleeve to cause uneven images to form images having low quality.

Then, the binder, the colorant, the wax, etc., in the toners of the 1st aspect and the 2nd aspect of the invention are explained in detail.

(Binder Resin)

It is preferred that the binder resin used in the invention is composed of two or more kinds of resins. In general, the control of the molecular weight distribution depends upon the synthetic conditions such as a reaction temperature, a reaction time, etc. In a small-scale experiment, there is relatively freedom in synthetic conditions and the detailed control of the molecular weight distribution is possible. However, in the production facilities of carrying out a large-scale synthesis, by the restriction of the synthetic conditions caused by the problems of facilities, the molecular weight distribution cannot be controlled in detail. Thus, when it is necessary to carry out the detailed control of the molecular weight distribution as in the present invention in practical production facilities, it is preferred that two or more kinds of binder resins previously prepared are mixed at a desired ratio to prepare a desired molecular weight distribution, and the mixture is used as the binder resin.

That is, the above-described binder resin is composed of at least two kinds of a binder resin (A) and a binder resin (B), and it is preferred that the weight average molecular weight of the binder resin (A) is from 8000 to 18000, the ratio (Mw/Mn) of the weight average molecular weight (Mw) to the number average molecular weight (Mn) thereof is from 2 to 4, the weight average molecular weight of the binder resin (B) is from 20,000 to 40,000, and the ratio (Mw/Mn) of the weight average molecular weight (Mw) to the number average molecular weight (Mn) thereof is from 3 to 5. By mixing the binder resin (A) and the binder resin (B) each having the molecular weight distribution in the above-described range, at a ratio of from 2:8 to 8:2, the toner of the 1st aspect of the invention or the toner of the 2nd aspect of the invention can be suitably prepared.

The binder resins used in the invention include the homopolymers or the copolymers of styrenes such as styrene, chlorostyrene, etc.; mono-olefins such as ethylene, propylene, butylene, isoprene, etc.; vinyl esters such as vinyl acetate, vinyl propionate, vinyl benzoate, etc.; α-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate, dodecyl methacrylate, etc.; vinyl ethers such as vinyl methyl ether, vinyl ethyl ether, vinyl butyl ether, etc.; vinyl ketones such as vinyl methyl ketone, vinyl hexyl ketone, vinyl isopropenyl ketone, etc. In particular, typical binder resins include polystyrene, a styrene-alkyl acrylate copolymer, a styrene-alkyl methacrylate copolymer, a styrene-acrylonitrile copolymer, a styrene-butadiene copolymer, a styrene-maleic anhydride copolymer, polyethylene, and polypropylene. Furthermore, there are polyester, polyurethane, an epoxy resin, a silicone resin, polyamide, denatured rosin, paraffin, and waxes. They can be used singly or a mixture of two or more kinds thereof.

In these resins, particularly; polyester is effectively used as the binder resin. For example, a polyester resin composed of the polycondensation product obtained using bisphenol A and a polyhydric aromatic carboxylic acid as the main monomer constituents can be preferably used.

The polyester resin used in the invention is synthesized by the polycondensation of a polyol component and a polycarboxylic acid component. The polyol component includes ethylene glycol, propylene glycol, 1,3-butanediol, 1,4-butanediol, 2,3-butanediol, diethylene glycol, triethylene glycol, 1,5-butanediol, 1,6-hexanediol, neopentyl glycol, cyclohexane dimethanol, hydrogenated bisphenol A, a bisphenol A-ethylene oxide adduct, a bisphenol A-propylene oxide adduct, etc.

The above-described polycarboxylic acid component includes maleic acid, fumaric acid, phthalic acid, isophthalic acid, terephthalic acid, succinic acid, dodecenylsuccinic acid, trimellitic acid, pyromellitic acid, cyclohexanetricarboxylic acid, 2,5,7-naphthalene-tricarboxylic acid, 1,2,4-naphthalenetricarboxylic acid, 1,2,5-hexanetricarboxylic acid, 1,3-dicarboxyl-2-methylene carboxypropanetetramethylenecarboxylic acid, and the anhydrides of them.

The polyester resin preferably used in the invention can be produced by the following method, etc. The polyester having a hydroxyl group is obtained by heating the. polycarboxylic acid and the polyol described above to a temperature of from 150 to 280° C. with stirring in the existence of a known esterification catalyst to carry out the dehydrocondensation. It is effective to reduce pressure for improving the reaction rate of the end of reaction. By controlling the heating temperature, the stirring speed, the extent of the reduced pressure, and the reaction time, and optimizing each of the conditions, the binder resin having the molecular weight distribution as the binder resin (A) or the binder resin (B) can be produced.

Also, as the method of mixing the binder resin (A) and the binder resin (B), there are following methods. That is, there are a method of dissolving the binder resin (A) and the binder resin (B) in a solvent capable of dissolving these resins and after mixing, distilling off the solvent, a method of melt-mixing the binder resin (A) and the binder resin (B) using a kneader such as an extruder, etc.

In the mixing method using a solvent, because the solvent is easily distilled off at a low temperature, after dispersing the solvent solution of the binder resin (A) and the binder resin (B) in water, the solvent can be distilled off from the aqueous dispersion. In the method, after distilling off the solvent, by collecting the dispersed resins from water by filtration followed by washing and drying, the binder resin is obtained. As the solvent which can be used in the method, a solvent having a boiling point of not higher than 100° C., which can be easily distilled off, is particularly preferred.

In the melt-mixing method, when the temperature is high at mixing, the ester exchange of the binder resin (A) and the binder resin (B) occurs by the transesterification, whereby the low-temperature fixing property and the anti-offset property are deteriorated. Accordingly, the temperature at mixing is usually not higher than 150° C., preferably not 120° C., and more preferably not higher than 100° C. Also, for restraining the occurrence of the transesterification, a known ester exchange preventing agent can be used.

Also, the softening point of the above-described binder resin is preferably from 90 to 150° C., and more preferably from 100 to 140° C. When the softening point is lower than 90° C., the heat shelf stability is sometimes deteriorated. On the other hand, when the softening point is higher than 150° C., the low-temperature fixing property is sometimes deteriorated.

The grass transition point of the above-described binder resin is preferably from 55 to 75° C., and more preferably from 55 to 70° C. When the glass transition point is lower than 55° C., the heat shelf stability is sometimes deteriorated. On the other hand, when the glass transition point is higher than 75° C., the low-temperature fixing property is sometimes deteriorated.

The acid value of the binder resin is preferably from 5 to 30 and the hydroxyl value thereof is preferably from 5 to 40.

(Colorant)

Typical examples of the colorants used in the invention include carbon black, Nigrosine, Aniline Blue, Calcoil Blue, Chrome Yellow, Ultramarine Blue, Du Pont Oil Red, Quinolin Yellow, Methylene Blue Chloride, Phthalocyanine Blue, Malachite Glean•Oxalate, Lamp Black, Rose Bengal, C.I. Pigment•Red 48:1, C.I. Pigment•Red 122, C.I. Pigment•Red 57:1, C.I. Pigment Yellow 97, C.I. Pigment•Yellow 12, C.I. Pigment•Blue 15:1. C.I. Pigment•Blue 15:3, etc.

It is preferred that the wax used in the invention has a melting point in the temperature range of from 70 to 100° C. and also has a melt viscosity of from 1 to 200 mPa·s at 110° C., and it is more preferred that the wax has a melting point in the temperature range of from 80 to 95° C. and also has a melt viscosity of from 1 to 100 mPa·s at 110° C. When the melting point is lower than 70° C., the changing temperature of the wax is too low, whereby the anti-blocking property is sometimes deteriorated and when the temperature in the copying machine becomes high, the developing property is sometimes deteriorated. On the other hand, when the melting point exceeds 100° C., the changing temperature of the wax is too high, whereby fixing may be carried out at a high temperature, which is undesirable in the view point of energy saving. Also, when the melt viscosity of the wax is higher than 200 mPa·s, the eluation of the wax from the toner is weak, whereby it sometimes happens that the fix releasing property becomes insufficient.

In the above-described wax, the endothermic initiation temperature in the DSC curve measured by a differential scanning calorimeter is preferably at least 40° C., and more preferably at least 50° C. When the endothermic initiation temperature is lower than 40° C., it sometimes happens that in the copying machine and a toner bottle, the aggregation of the toners occurs. The endothermic initiation temperature depends upon a low molecular weight in the molecular weight distribution constituting the wax and the kind and the amounts of the polar groups of the structure. In general, when the molecular weight is increased, the endothermic initiation temperature is raised together with the melting point which, by manner, the low melting point and the low viscosity specific to the wax are spoiled. Thus, it is effective to selectively removing these low molecular weight waxes only in the molecular weight distribution of the wax, and as the method, there are the methods by a molecular distillation, a solvent fractionation, a gas chromatographic fractionation, etc.

The content of the above-described wax to the toner is preferably from 5 to 10% by weight, and more preferably from 5 to 8% by weight. When the content of the wax is less than 5% by weight, a sufficient fixing latitude (the heat roller temperature range capable of fixing without causing offset of toner) is not obtained. On the other hand, when the content is larger than 10% by weight, the amount of free wax released from the toner is increased, whereby the holding member of a developer is liable to be stained. Also, the powder fluidity of the toner is deteriorated and also, the free wax attaches to the surface of a photoreceptor forming thereon electrostatic latent images, whereby electrostatic latent images can not be sometimes accurately formed. Furthermore, because the wax is inferior in transparency as compared with the binder resin, it sometimes happens that the transparency of images of OHP, etc., is lowered and a blackish image is projected.

The wax used in the invention includes, for example, a paraffin wax and the derivatives thereof, a montan wax and the derivatives thereof, a microcrystalline wax and the derivatives thereof, a Fischer-Tropsch wax and the derivatives thereof, and a polyolefin wax and the derivatives thereof. The derivatives include oxides, polymers with a vinyl monomer, and graft denatured products. In addition to the above-described waxes, alcohols, fatty acids, vegetable waxes, animal waxes, mineral waxes, ester waxes, acid amides, etc., can be utilized. They can be used singly or as a mixture of two or more kinds.

The toner of the invention contains at least the binder resin, the colorant, and the wax, and by dispersing inorganic fine particles in the inside of the toner as an other component, the wax can be finely and uniformly dispersed. Furthermore, by finely dispersing inorganic fine particles in the inside of the toner, the storage elastic modulus of the toner becomes large and the anti-offset property is further improved.

As the inorganic fine particles used in the invention, the particles of known organic compound such as silica, alumina, titania, etc., can be used without any particular restriction and they may be used singly or as a mixture of two or more kinds of them. In the invention, from the view point of the OHP transparency, silica having a smaller refractive index than that of the binder resin is preferably used. The mean primary particle size of the inorganic fine particles is preferably from 5 to 100 nm, and more preferably from 10 to 40 nm.

As the practical fine particles of silica, in addition to anhydrous silica, fine particles containing aluminum silicate, sodium silicate, potassium silicate, etc., may be used but the fine particle composition having the refractive index of not higher than 1.5 is preferred.

Also, these inorganic fine particles may be surface-treated using various methods. For example, inorganic fine particles surface-treated with a silane-based coupling agent, a titanium-based coupling agent, a silicone oil, etc., can be preferably used.

The content of the inorganic fine particles to the toner is preferably from 1 to 10% by weight, and more preferably from 2 to 7% by weight. When the content of the inorganic fine particles is less than 1% by weight, the effect of increasing the storage elastic modulus is scarcely obtained and as the case mat be, the anti-offset property is lowered. On the other hand, when the content exceeds 10% by weight, the surface of the toner image after fixing does not become uniform and the fixed image surface having unevenness is formed. In color images, the color reproducing region is narrowed by the unevenness of the fixed image surface and the glossiness is liable to be lowered, whereby the correspondence to full color is liable to become difficult.

The toner of the invention can contain at least one kind of a charging controlling agent of controlling electrostatic charging as an internal additive. Also, for satisfying the grinding property and the heat shelf stability of the toner, the toner may contain a petroleum-base resin. The petroleum-base resin is synthesized using, as the raw materials, diolefins and monoolefins contained in a cracked oil fraction by-produced from an ethylene plant of producing ethylene, propylene, and the like by steam cracking of petroleums.

Furthermore, for further improving the long storage stability, the fluidity, the developing property, and the transferring property of the toner, an inorganic power and/or a resin powder may be added to the surface of the toner of the invention as an external additive. The inorganic powder includes, for example, carbon black, silica, alumina, titania, and zinc oxide and the resin powder includes, for example, the spherical fine particles of PMMA, nylon, melamine, benzoguanamine, fluorine-base resins, etc., the amorphous powder of vinylidene chloride, fatty acid metal salts, etc.

The addition amount of the above-described external additive is preferably from 0.2 to 4% by weight, and more preferably from 0.5 to 3% by weight to the toner.

[Two-component Developer]

The two-component developer of the invention contains the above-described electrostatic charge developing toner of the invention and a carrier.

There is no particular restriction on the above-described carrier if the carrier is a known carrier, and for example, an iron powder-based carrier, a ferrite-based carrier, and a surface coated ferrite carrier can be used.

[Production Method of Electrostatic Charge Developing Toner]

The above-described electrostatic charge developing toner of the invention can be preferably produced by a known melt-kneading method. That is, the addition of the above-described internal additive to the inside of the toner particles is carried out by a kneading treatment. In this case, kneading can be carried out using various kinds of heat kneaders. As the heat kneader, there are, for example, a three-roll type kneader, a single screw type kneader, a twin screw type kneader, and a bambury mixer type kneader.

In the production method of the toner of the invention, grinding and classification may be carried out by optional methods. Grinding of the above-described kneaded product can be carried out using, for example, a micronizer, Ulumax, Jet-o-miser, KTM (Krypton), and a turbo-mill. Furthermore, an I-type Jet-Mill can be used. For the classification, an elbow jet using a Coanda effect, an air classification, etc., can be used and as a post step, by applying a Hybridization system (manufactured by Nara Kikai Seisakusho K.K.), a Mechanofusion system (manufactured by Hosokawa Micron K.K.), a Kryptron system (manufactured by Kawasaki Heavy Industries, Ltd.), etc., the shape can be changed, and formation of spherical forms by hot blast can be also used.

[Image-forming Process]

The image-forming process of the invention is an image-forming process including a latent image-forming step of forming an electrostatic latent image on a latent image holding member, a developing step of forming a toner image by developing the electrostatic latent image with a toner, a transfer step of transferring the toner image onto a transfer material to form a transfer image, and a fixing step of fixing the transfer image using a fixing apparatus comprising, for example, a heat roller and a press roller, wherein the above-described toner is the toner of the invention, the surfaces of the above-described heat roller and press roller are formed with a releasing resin such as, for example, a fluorine resin, and a releasing liquid is not substantially supplied to the surfaces.

According to the image-forming process of the invention, fixed images excellent in the low-temperature fixing property, the OHP transparency, and the anti-offset property, and having a high glossiness can be formed.

The surfaces of the heat roller and the press roller which are used in the invention are formed with a fluorine resin and it is preferred to have an elastic layer and a surface layer formed with a fluorine resin on the surface of a core in this order. The rubber hardness of the elastic layer is preferably from 10 to 40 degrees, and more preferably from 20 to 40 degrees by Asker C. Also, the rubber hardness of the heat roller and the press roller in the state of forming the above-described surface layer on each surface is preferably from 55 to 85 degrees, and more preferably from 60 to 80 degrees by Asker C.

In the fixing process using a heat roller and a press roller, fixing is carried out by pressing the heat roller and the press roller each other to form a nip region. The unfixed toner transferred onto a recording medium is melted by heating in the nip region to form a fixed image on the recording medium. In this case, the time t (millisecond) of heat-pressing the unfixed toner is, when the width of the nip region is w (mm) and the peripheral speed of the roller is v (mm/second), shown by t=w/v. Thus, when the width of the nip region is wide, time for the heat to be conducted to the unfixed toner becomes long. In the case of the toners for full color, it is required that the toners are transferred on the recording medium in overlapped state and are melt-mixed, whereby it is necessary to more sufficiently conduct heat to the toners than in the case of a toner for black and white images. Accordingly, for fixing full color toners, it becomes necessary to widen the nip width.

When the rubber hardness of the heat roller and the press roller described above is lower than 55 degrees by Asker C, the durability of the rollers becomes sometimes inferior. On the other hand, when the rubber hardness thereof exceeds 85 degrees by Asker C, because the rollers are hard, in order to ensure the wide nip width, a load is increased, whereby it sometimes happens that the heat roller is defected, which causes the formations of paper creases and uneven fixing. In this case, it is preferred that the hardness of the elastic layer is from 10 to 40 degrees by Asker C. By making the hardness of the elastic layer the low hardness as in the above-described range, the nip width can be widened at a low load, and the rubber hardness of the above-described heat roller and press roller can be realized. Also, by using such heat roller and press roller, the pressing force of the heat roller and the press roller can be established to a low pressure of from 392 to 638 N and fixed images without paper creases and uneven fixing can be formed.

In the fixing step of the image-forming process of the invention, the less amount of a releasing liquid such as a silicone oil, etc., coated to the heat roller, the more effective. A releasing liquid is effective for the fixing latitude, but because the releasing liquid is transferred to the transfer material to be fixed, stickiness occurs and also there are problems that a tape cannot be stuck to the transfer material, letters cannot be added by writing with a felt-tip pen, etc. This is remarkable on OHP. Also, because the releasing liquid cannot make smooth the roughness of the surface of the fixed image on the transfer material, it causes lowering the OHP transparency.

Since the above-described construction of the toner of the invention shows a sufficient fixing latitude, a releasing liquid such as a silicone oil, etc., coated on the heat roller may not substantially be used. However, in the case of coping with high-speed printing, a slight amount of the releasing liquid may be supplied. In the case, the supplying amount thereof may be not more than 1$\mu$ liter per one A4 paper. When the amount of the releasing liquid is in the above-described range, the occurrence of the above-described problems can be substantially avoided.

In the image-forming process of the invention, fixed images having a high glossiness can be obtained. Because the glossiness of a fixed image largely depends upon the structure of the fixing apparatus and the fixing condition, it is difficult to obtain a high gloss by satisfying all the conditions but in the present invention, a high glossiness can be obtained by the following conditions. That is, in the invention, in the state of substantially not supplying a releasing liquid to the surface of the heat roller, using a recording paper having a basis weight of from 50 to 120 g/m$^2$ as the recording material, and when the toner image is fixed to the recording paper by heat-pressing under the conditions that the surface temperatures of the heat roller and the press roller are from 150 to 180° C. and the peripheral speed of the heat roller and the press roller is from 70 to 120 mm/second, a fixed image having a glossiness (75 degree gloss) of from 40 to 60, preferably 40 to 50, can be formed when the toner carried amount formed on the recording paper is 0.50 mg/cm$^2$. The image having such a high glossiness is suitable for a pictorial image and an OHP image and gives a fill color image having a high quality.

Then, the examples of the invention are described below but the invention is not limited to these examples. In addition, all "parts" in the following explanation, unless otherwise indicated, are "by weight".

First, examples of the toner of the 1st aspect of the invention are explained.

[Measurement of Integral Molecular Weight Distribution]

The measurement of the molecular weight distribution is carried out under the following conditions. As GPC, an HLC-8120 GPC, SC-8020 apparatus (manufactured by TOSOH CORPORATION) is used, as the column, two TSK gels, Super HM-H (manufactured by TOSOH CORPORATION, 6.0 mm ID×150 cm) are used, and as an eluent, THF (tetrahydrofuran) is used. As the experimental conditions, the sample concentration is 0.5%, the flow rate is 0.6 ml/minute, the sample injection amount is 10$\mu$ liter, the measurement temperature is 40° C., and the experiment is carried out using an IR detector. Also, the calibration curve is prepared from 10 samples of the polystyrene standard samples, TSK standard (manufactured by TOSOH CORPORATION): A-500, F-1, F-10, F-80, F-380, A-2500, F-4, F-40. F-128, and F-700. Also, the data collection interval in the sample analysis is 300 ms.

Based on the data thus obtains, the value of the integral molecular weight distribution of the molecular weight $M_i$ is obtained by the following formula.

Integral molecular weight distribution: $W(M_i)=$ $$(\Sigma h_j-\Sigma h_j)\times 100/\Sigma h_i$$

wherein $\Sigma h_i$ is the sum of the heights from the base line in the molecular weight of from 0 to $M_i$ and $\Sigma h_j$ is the sum of the heights from the base line in all the molecular weight

[Preparation of Binder Resin]

The monomers shown in following Table 1 are selected and 6 kinds of linear polyesters having various molecular weight distributions are prepared. Also, as the wax, two kinds of waxes shown in Table 2 below are used.

TABLE 1

| | Mn | Mw | Mw/Mn | Molecular weight of at least $5\times10^5$ (wt. %) | Monomers |
|---|---|---|---|---|---|
| Linear polyester 1 | 5200 | 20500 | 3.94 | 0.0 | Terephthalic acid/ bisphenol A.ethylene oxide adduct/bisphenol |

TABLE 1-continued

| | Mn | Mw | Mw/Mn | Molecular weight of at least $5 \times 10^5$ (wt. %) | Monomers |
|---|---|---|---|---|---|
| | | | | | A.propylene oxide adduct/cyclohexane dimethanol |
| Linear polyester 2 | 3200 | 10500 | 3.28 | 0.0 | Terephthalic acid/ bisphenol |
| | | | | | A.propylene oxide adduct/cyclohexane dimethanol |
| Linear polyester 3 | 4500 | 14500 | 3.22 | 0.0 | Terephthalic acid/ bisphenol |
| | | | | | A.propylene oxide adduct |
| Linear polyester 4 | 7000 | 27500 | 3.93 | 0.0 | Terephthalic acid/ bisphenol |
| | | | | | A.ethylene oxide adduct/cyclohexane dimethanol |
| Linear polyester 5 | 6500 | 24000 | 3.69 | 0.0 | Terephthalic acid/ bisphenol |
| | | | | | A.propylene oxide adduct |
| Linear polyester 6 | 7500 | 40000 | 5.33 | 4.3 | Terephthalic acid/ bisphenol |
| | | | | | A.propylene oxide adduct/bisphenol |
| | | | | | A.ethylene oxide adduct/ethylene glycol |

TABLE 2

| | Content of wax | Melting Point (° C.) | Melt viscosity at 110° C. (mPa · s) |
|---|---|---|---|
| Wax A | Microcrystalline wax | 85 | 110 |
| Wax B | Heptatriacontanol oxalate | 103 | 150 |

EXAMPLE 1

[Preparation of Toner 1]

Linear polyester 1 92 parts

Magenta pigment (C.I. Pigment•Red 57:1) 3 parts

Wax A 5 parts

The above-described mixture is kneaded by an extruder, and after grinding the kneaded mixture by a grinder of a surface grinding system, fine particles and crude particles are classified by an air classifier to obtain a magenta toner 1 of $d_{50}$=6.8 μm.

EXAMPLE 2

[Preparation of Toner 2]

Linear polyester 3 66 parts

Linear polyester 4 26 parts

Magenta pigment (C.I. Pigment•Red 57:1) 3 parts

Wax A 5 parts

The above-described mixture is kneaded by an extruder, and after grinding the kneaded mixture by a grinder of a surface grinding system, fine particles and crude particles are classified by an air classifier to obtain a magenta toner 2 of $d_{50}$=6.9 μm.

EXAMPLE 3

[Preparation of Toner 3]

Linear polyester 1 73 parts

Linear polyester 2 5 parts

Linear polyester 5 9 parts

Magenta pigment (C.I Pigment•Red 57:1) 3 parts

Silica fine particles 5 parts (mean primary particle size 16 nm, R 972, manufactured by Nippon Aerosil K.K.)

Wax A 5 parts

The above-described mixture is kneaded by an extruder, and after grinding the kneaded mixture by a grinder of a surface grinding system, fine particles and crude particles are classified by an air classifier to obtain a magenta toner 3 of $d_{50}$ =6.8 μm.

COMPARATIVE EXAMPLE 1

[Preparation of Toner 4]

Linear polyester 2 80 parts

Linear polyester 4 12 parts

Magenta pigment (C.I. Pigment•Red 57:1) 3 parts

Wax A 5 parts

The above-described mixture is kneaded by an extruder, and after grinding the kneaded mixture by a grinder of a surface grinding system, fine particles and crude particles are classified by an air classifier to obtain a magenta toner 4 of $d_{50}$=6.2 μm.

COMPARATIVE EXAMPLE 2

[Preparation of Toner 5]

Linear polyester 2 65 parts

Linear polyester 6 27 parts

Magenta pigment (C.I. Pigment•Red 57:1) 3 parts

Wax B 5 parts

The above-described mixture is kneaded by an extruder, and after grinding the kneaded mixture by an I-type jet mill grinder in a shortened residence time, fine particles and crude particles are classified by an air classifier to obtain a magenta toner 5 of $d_{50}$=7.6 μm.

COMPARATIVE EXAMPLE 3

[Preparation of Toner 6]

Linear polyester 3 92 parts

Magenta pigment (C.I. Pigment•Red 57:1) 3 parts

Wax A 5 parts

The above-described mixture is kneaded by an extruder, and after grinding the kneaded mixture by a grinder of a surface grinding system, fine particles and crude particles are classified by an air classifier to obtain a magenta toner 6 of $d_{50}$=6.7 μm.

About the toners 1 to 6 obtained as described above, the integral molecular weight distribution of each toner is measured by the same method as the above-described method of measuring the integral molecular weight distribution of the binder resin. Also, by an image analyzer (Type LUZEX 5000™, manufactured by Nippon Regulator K.K.), SF-1 and SF-2 of each toner are measured. These results are shown in Table 3 below.

TABLE 3

| | | Mn | Mw | Molecular weight of at least $5 \times 10^5$ (wt. %) | W ($5 \times 10^3$)/ W ($5 \times 10^5$) | Molecular weight of at least $3 \times 10^3$ (wt. %) | SF-1 | SF-2 |
|---|---|---|---|---|---|---|---|---|
| Example 1 | Toner 1 | 5200 | 20500 | 0.0 | 25.4 | 28 | 142 | 115 |
| Example 2 | Toner 2 | 4700 | 19800 | 0.0 | 18.5 | 21 | 145 | 119 |
| Example 3 | Toner 3 | 5300 | 21800 | 0.0 | 32.5 | 23 | 140 | 112 |
| Comparative Example 1 | Toner 4 | 3500 | 18500 | 0.0 | 11.8 | 22 | 140 | 118 |
| Comparative Example 2 | Toner 5 | 4600 | 29400 | 1.8 | 16.5 | 28 | 161 | 142 |
| Comparative Example 3 | Toner 6 | 4500 | 14500 | 0.0 | 55.8 | 42 | 138 | 111 |

[Preparation of Developer]

To 100 parts of each toner obtained as described above are added 1.0 part of negative-charging silica and 0.5 part of negative-charging titania to provide an external-added toner. By mixing 100 parts of a carrier obtained by coating ferrite having a particle size of 50 μm with a styrene-methyl methacrylate copolymer and 6 parts of the external-added toner, each developer is prepared.

[Image Formation]

Using these developers, copy tests are carried out by a test machine obtained by reconstructing the electrophotographic copying machine (A-Color 935, manufactured by FUJI XEROX CO., LTD.). In this case, a heat roller and a press roller each having a rubber hardness of 65 degrees by Asker C and each having an elastic layer using a rubber having a rubber hardness of 24 degrees by Asker C and a thickness of 7.5 mm and a surface layer formed by covering the surface with polytetrafluoroethylene tube having a thickness of 20 μm are used. Also, the pressing force of the heat roller and the press roller is established to 490 N and in this case, the peripheral speeds of the heat roller and the press roller are set to 100 mm/second respectively.

For the test, each solid unfixed toner image having a length of 5 cm and a width of 4 cm is formed on a transfer paper of A4 having a basis weight of 100 g/m$^2$ for the electrophotographic copying machine (A-COLOR 935™, manufactured by FUJI XEROX CO., LTD.). In this case, each toner image is formed such that the toner amount of the tnansfer paper becomes 0.5 mg/cm$^2$ or 1.5 mg/cm$^2$.

<Evaluations of Low-temperature Fixing Property and Anti-offset Property>

Using the solid unfixed toner image having the toner amount of 1.5 mg/cm$^2$ and using a test machine, a reconstructed one of the above-described copying machine, A-Color 935 such that the heat roller temperature and the press roller temperature can be freely established and can monitor, the test is carried out in the state of substantially not existing a releasing oil on the surface of the heat roller by stopping the supply of the releasing oil to the heat roller. That is, the surface temperature of the heat roller is stepwise changed and at each surface temperature, fixing of the unfixed toner image is carried out using the above-described transfer paper carrying the toner image. In this case, whether or not a toner stains occurred from the heat roller on blank portions of the paper is observed, and the temperature region of not causing stains is defined as a non-offset temperature region. The measurement results are shown in Table 4 below.

The evaluation of the low-temperature fixing property is as follows. That is, the case that the lower limit temperature of the non-offset temperature region is lower than 135° C. is evaluated as A, the case that the lower limit temperature is 135° C. or higher but lower than 145° C. as B, and the case that the lower limit temperature is 145° C. or higher as C.

The evaluation of the anti-offset property is as follows. That is, the case that the upper limit temperature of the non-offset temperature region is 180° C. or higher is evaluated as A, the case that the upper limit temperature is 170° C. or higher but lower than 180° C. as B, and the case that the upper limit temperature is lower than 170° C. as C.

<Measurement of Glossiness>

Using the solid unfixed toner image having the toner amount of 0.5 mg/cm2, the test at 160° C. is carried out in the state of substantially not existing a releasing oil on the surface of the heat roller by stopping the supply of the releasing oil to the heat roller. In this case, the glossiness of 75 degree of the fluid sample is measured using GLOSS METER™ (manufactured by Mirakami Shihisai Kogaku Kenkyusho). The measurement results are shown in Table 4 below.

<Evaluation of OHP Transparency>

Using the solid unfixed toner image having the toner amount of 0.5 mg/cm$^2$, the test at 160° C. is carried out in the state of substantially not existing a releasing oil on the surface of the heat roller by stopping the supply of the releasing oil to the heat roller. The ratio of the transmitted light of the fixed image to the incident light is determined and the ratio is defined as the OHP transparency. Practically, as the incident light component of the transmitted light, the value of condensed light at a potential angle of 3.5 degree is used and by the ratio of the value to the value of condensed light at a potential angle of 45 degrees, the light transmittance is determined. The measurement results are shown in Table 4 below.

As the OHP transparency, the case of at least 80% is evaluated as A, the case of 70% or higher but lower than 80% as B, and the case of lower than 70% as C.

TABLE 4

| | Toner | Non-offset temperature region (° C.) | Low-temp. Fixing property | Anti-offset property | OHP transparency (%) | glossiness at 160° C. |
|---|---|---|---|---|---|---|
| Example 1 | Toner 1 | 130 to 190 | A | A | 81(A) | 48 |
| Example 2 | Toner 2 | 128 to 181 | A | A | 87(A) | 56 |
| Example 3 | Toner 3 | 134 to 195 | A | A | 85(A) | 53 |

TABLE 4-continued

| | Toner | Non-offset temperature region (° C.) | Low-temp. Fixing property | Anti-offset property | OHP transparency (%) | glossiness at 160° C. |
|---|---|---|---|---|---|---|
| Comparative Example 1 | Toner 4 | 118 to 165 | A | C | 80(A) | 54 |
| Comparative Example 2 | Toner 5 | 155 to 200 | C | A | 68(C) | 32 |
| Comparative Example 3 | Toner 6 | 115 to 160 | A | C | 78(B) | 44 |

From the results of Table 3 and Table 4, it can be seen that the toners of the invention of Examples 1 to 3 can satisfy all the low-temperature fixing property, the anti-offset property, and the OHP transparency because in regard to the molecular weight by GPC in the THF dissolved components, the ratio of at least $5\times10^5$ in the integral molecular weight distribution is not larger than 1% by weight, the ratio of not higher than $3\times10^3$ is not larger than 30% by weight, and the ratio $\{W(5\times10^3)/W(1\times10^3)\}$ of the ratio $\{W(5\times10^3)\}$ of not higher than $5\times10^3$ in the integral molecular weight distribution to the ratio $\{W(1\times10^5)\}$ of at least $1\times10^5$ in the integral molecular weight distribution is from 15 to 50. Also, it can be seen that because the toner of Example 3 contains the inorganic fine particles in the inside thereof, the fixable temperature range is wide as at least 60° C. and the toner shows very excellent characteristics.

On the other hand, in the toner of Comparative Example 1, the ratio of at least $5\times10^5$ in the integral molecular weight distribution is not larger than 1% by weight and the ratio of not higher than $3\times10^3$ is not larger than 30% by weight, but because the above-described ratio $\{W(5\times10^3)/W(1\times10^3)\}$ is 11.8 which is smaller than 15, although the low-temperature fixing property and the OHP transparency are sufficient, the anti-offset property cannot be satisfied.

In the toner of Comparative Example 2, the above-described ratio $\{W(5\times10^3)/W(1\times10^5)\}$ is 16.5 which is larger than 15, but because the ratio of at least $5\times10^5$ in the integral molecular weight distribution exceeds 1% by weight and further because the melt viscosity of the wax is high, although the anti-offset property can be satisfied, the OHP transparency is insufficient and the low-temperature fixing property cannot be sufficiently satisfied. Also, because the toner 5 does not satisfy the conditions that SF 1 is from 130 to 160 and SF 2 is from 110 to 140, the transfer property of the toner becomes insufficient and a deletion occurs in the inside of the solid image.

In the toner of Comparative Example 3, the ratio of at least $5\times10^3$ in the integral molecular weight distribution is not larger than 1% by weight, but because the ratio of not higher than $3\times10^3$ exceeds 30% by weight and further because the above-described ratio $\{W(5\times10^3)/W(1\times10^5)\}$ is 55.8 which is larger than 50, although the low-temperature fixing property can be satisfied, the anti-offset property cannot be satisfied and also the OHP transparency is insufficient.

Then, the examples of the toner of the 2nd aspect of the invention are explained.

[Measurement of Differential Molecular Weight Distribution]

The molecular weight distribution is carried out in the following conditions. An HLC-8120 GPC, SC-8020 apparatus (manufactured by TOSOH CORPORATION) is used, as a column, TSK gel, Super HM-H (6.0 mm ID×15 cm×2) is used, and as an eluent, THF (tetrahydrofuran) is used. As the experimental conditions, the sample concentration is 0.5%, the flow rate is 0.6 ml/minute, the sample injection amount is 10 $\mu$ liter, and the measurement temperature is 40° C. The calibration curve is prepared from 10 samples of A-500, F-1, F-10, F-80, F-380, A-2500, F-4, F-40, F-128, and F-700. Also, the data collection interval in the sample analysis is set to 300 ms. Based on the data thus obtains, the value of the differential molecular weight distribution of the molecular weight $M_i$ is obtained by the following formula.

Differential molecular weight distribution: $W(M_i)=y_i/\Sigma y_i$

In the formula: $y_i=h_i dT/(\log(M_{i+1})-\log(M_i))$ wherein, dT: Data collection interval, $h_i$: Height from base line, and $M_i$: Molecular weight.

[Preparation of Binder Resin]

Monomers shown in Table 5 below are selected and 7 kinds of linear polyesters having various molecular weight distributions are prepared.

Also, as the wax, 3 kinds of waxes shown in Table 6 below are used.

TABLE 5

| | Mn | Mw | Mw/Mn | Molecular weight of at least $1\times10^6$ (wt. %) | Monomers |
|---|---|---|---|---|---|
| Linear polyester 7 | 5450 | 21400 | 3.93 | 0.0 | Terephthalic acid/bisphenol A.ethylene oxide adduct/bisphenol A.propylene oxide adduct/cyclohexane dimethanol |
| Linear polyester 8 | 3200 | 10500 | 3.28 | 0.0 | Terephthalic acid/bisphenol A.propylene oxide adduct/cyclohexane dimethanol |
| Linear polyester 9 | 4500 | 14000 | 3.11 | 0.0 | Terephthalic acid/bisphenol A.propylene oxide adduct/cyclohexane dimethanol |
| Linear polyester 10 | 7500 | 29500 | 3.93 | 0.0 | Terephthalic acid/bisphenol A.propylene oxide adduct |
| Linear polyester 11 | 6500 | 25000 | 3.85 | 0.0 | Terephthalic acid/bisphenol A.ethylene oxide adduct |
| Linear polyester 12 | 5900 | 21000 | 3.56 | 0.0 | Terephthalic acid/bisphenol A.ethylene oxide adduct |
| Linear polyester 13 | 7500 | 40000 | 5.33 | 5.5 | Terephthalic acid/bisphenol A.ethylene oxide adduct/ethylene glycol |

TABLE 6

| | Content of wax | Melting Point (° C.) | Melt viscosity at 110° C. (mPa · s) |
|---|---|---|---|
| Wax C | Granular purified carnauba wax | 83 | 50 |
| Wax D | Microcrystalline wax | 85 | 110 |
| Wax E | Heptatriacontanole oxalate | 103 | 150 |

EXAMPLE 4

[Preparation of Toner 7]

Linear polyester 7 92 parts

Magenta pigment (C.I. Pigment•Red 57 1) 3 parts

Wax C 5 parts

The above-described mixture is kneaded by an extruder, and after grinding the kneaded mixture by a grinder of a surface grinding system, fine particles and crude particles are classified by an air classifier to obtain a magenta toner 7 of $d_{50}$=6.7 μm

EXAMPLE 5

[Preparation of toner 8]

Linear polyester 8 52 parts

Linear polyester 11 35 parts

Magenta pigment (C.I. Pigment•Red 57:1) 3 parts

Silica fine particles 5 parts (mean primary particle size 16 nm, R 972, manufactured by Nippon Aerosil K.K.)

Wax C 5 parts

The above-described mixture is kneaded by an extruder, and after grinding the kneaded mixture by a grinder of a surface grinding system, fine particles and crude particles are classified by an air classifier to obtain a magenta toner 8 of $d_{50}$=6.1 μm.

EXAMPLE 6

[Preparation of Toner 9]

Linear polyester 9 60 parts

Linear polyester 10 32 parts

Magenta pigment (C.I. Pigment•Red 57:1) 3 parts

Wax D 5 parts

The above-described mixture is kneaded by an extruder, and after grinding the kneaded mixture by a grinder of a surface grinding system, fine particles and crude particles are classified by an air classifier to obtain a magenta toner 9 of $d_{50}$=6.5 μm.

EXAMPLE 7

[Preparation of Toner 10]

Linear polyester) 65 parts

Linear polyester 11 27 parts

Magenta pigment (C.I. Pigment•Red 57:1) 3 parts

Wax D 5 parts

The above-described mixture is kneaded by an extruder, and after grinding the kneaded mixture by a grinder of a surface grinding system, fine particles and crude particles are classified by an air classifier to obtain a magenta toner 10 of $d_{50}$=6.8 μm.

COMPARATIVE EXAMPLE 4

[Preparation of Toner 11]

Linear polyester 8 80 parts

Linear polyester 11 12 parts

Magenta pigment (C.I. Pigment•Red 57:1) 3 parts

Wax D 5 parts

The above-described mixture is kneaded by an extruder, and after grinding the kneaded mixture by a grinder of a surface grinding system, fine particles and crude particles are classified by an air classifier to obtain a magenta toner 11 of $d_{50}$=6.2 μm.

COMPARATIVE EXAMPLE 5

[Preparation of Toner 12]

Linear polyester 9 75 parts

Linear polyester 12 17 parts

Magenta pigment (C.I Pigment•Red 57:1) 3 parts

Wax D 5 parts

The above-described mixture is kneaded by an extruder, and after grinding the kneaded mixture by an I-type jet mill grinder, fine particles and crude particles are classified by an air classifier to obtain a magenta toner 12 of $d_{50}$=7.6 μm.

COMPARATIVE EXAMPLE 6

[Preparation of Toner 13]

Linear polyester 8 49 parts

Linear polyester 13 43 parts

Magenta pigment (C.I. Pigment•Red 57 1) 3 parts

Wax C 5 parts

The above-described mixture is kneaded by an extruder, and after grinding the kneaded mixture by a grinder of a surface grinding system, fine particles and crude particles are classified by an air classifier to obtain a magenta toner 13 of $d_{50}$=6.9 μm.

COMPARATIVE EXAMPLE 7

[Preparation of Toner 14]

Linear polyester 8 49 parts

Linear polyester 13 43 parts

Magenta pigment (C.I. Pigment•Red 57:1) 3 parts

Wax E 5 parts

The above-described mixture is kneaded by an extruder, and after grinding the kneaded mixture by a grinder of a surface grinding system, fine particles and crude particles are classified by an air classifier to obtain a magenta toner 14 of $d_{50}$=7.8 μm.

About the toners 7 to 14 obtained by the above-described methods, the differential molecular weight distribution of each toner is measured by the same method as the measurement of the differential molecular weight distribution of the binder resin described above. Also, by an imaging analyzer (manufactured by Nippon Regulator K.K.), SF-1 and SF-2 of each toner are measured. These results are shown in Table 7 below.

TABLE 7

| | | Mn | Mw | Molecular weight of at least 1 × $10^6$ (wt. %) | Ratio of differential molecular weight distribution of 5 × $10^3$ (%) | Ratio of differential molecular weight distribution of 1 × $10^5$ (%) | SF-1 | SF-2 |
|---|---|---|---|---|---|---|---|---|
| Example 4 | Toner 7 | 5450 | 21400 | 0.0 | 0.32 | 0.07 | 141 | 116 |

TABLE 7-continued

| | | Mn | Mw | Molecular weight of at least 1 × $10^6$ (wt. %) | Ratio of differential molecular weight distribution of 5 × $10^3$ (%) | Ratio of differential molecular weight distribution of 1 × $10^5$ (%) | SF-1 | SF-2 |
|---|---|---|---|---|---|---|---|---|
| Example 5 | Toner 8 | 4600 | 18800 | 0.0 | 0.47 | 0.04 | 143 | 115 |
| Example 6 | Toner 9 | 5100 | 22500 | 0.0 | 0.35 | 0.12 | 143 | 118 |
| Example 7 | Toner 10 | 4800 | 20300 | 0.0 | 0.41 | 0.06 | 145 | 119 |
| Comparative Example 4 | Toner 11 | 3500 | 15500 | 0.0 | 0.58 | 0.04 | 142 | 120 |
| Comparative Example 5 | Toner 12 | 4500 | 29600 | 0.0 | 0.28 | 0.22 | 162 | 142 |
| Comparative Example 6 | Toner 13 | 4200 | 28400 | 2.25 | 0.47 | 0.18 | 144 | 115 |
| Comparative Example 7 | Toner 14 | 4200 | 28400 | 2.25 | 0.47 | 0.18 | 144 | 115 |

[Preparation of Developer]

To 100 parts of each toner obtained as described above are added 1.0 part of negative-charging silica and 0.5 part of negative-charging titania to provide an external-added toner. By mixing 100 parts of a carrier obtained by coating ferrite having a particle size of 50 $\mu$m with a styrene-methyl methacrylate copolymer and 6 parts of the external-added toner, each developer is prepared.

<Evaluations of Low-temperature Fixing Property, Anti-offset Property, Glossiness, and OHP Transparency>

Using each developer obtained, an image formation is carried out as in the case of the toner of the 1st aspect of the invention, the low-temperature fixing property, the anti-offset property, the glossiness, and the OHP transparency are evaluated as described above. The results are shown in Table 8 below.

TABLE 8

| | Toner | Non-offset temperature region (° C.) | Low-temp. Fixing property | Anti-offset property | OHP transparency (%) | glossiness at 160° C. |
|---|---|---|---|---|---|---|
| Example 4 | Toner 7 | 133 to 190 | A | A | 82(A) | 44 |
| Example 5 | Toner 8 | 120 to 180 | A | A | 88(A) | 56 |
| Example 6 | Toner 9 | 128 to 185 | A | A | 85(A) | 49 |
| Example 7 | Toner 10 | 130 to 190 | A | A | 81(A) | 52 |
| Comparative Example 4 | Toner 11 | 115 to 160 | A | C | 82(A) | 56 |
| Comparative Example 5 | Toner 12 | 160 to 215 | C | A | 78(B) | 35 |
| Comparative Example 6 | Toner 13 | 144 to 205 | B | A | 68(C) | 28 |
| Comparative Example 7 | Toner 14 | 155 to 220 | C | A | 52(C) | 22 |

From the results of Table 7 and Table 8, it can be seen that the toners of the invention of Examples 4 to 7 can satisfy all the low-temperature fixing property, the anti-offset property, and the OHP transparency because the molecular amount by GPC of the THF diffused component of each toner is distributed in the range of not larger than $1\times10^6$, the value of the differential molecular weight distribution of the molecular weight of $5\times10^3$ is not higher than 0.55%, and the differential molecular weight distribution of the molecular weight of $1\times10^5$ is not higher than 0.15%. Also, the images formed by these toners show very high glossiness of 40 or higher at 160° C. and thus, it can be seen that these toners can form pixel images having high image quality.

On the other hand, in the toner of Comparative Example 4, the above-described molecular weight is distributed in the range of not larger than $1\times10^6$ and the value of the differential molecular weight distribution of the above-described molecular weight of $1\times10^5$ is not larger than 0.15%, but because the value of the differential molecular weight distribution of the above-described molecular weight of $5\times10^3$ is larger than 0.55%, although the low-temperature fixing property and the OHP transparency may be satisfied, the anti-offset property cannot be satisfied.

In the toner of Comparative Example 5, the above-described molecular weight is distributed in the range of not larger than $1\times10^6$ and the value of the differential molecular weight distribution of the above-described molecular weight of $5\times10^3$ is not larger than 0.55%, but because the value of the differential molecular weight distribution of the above-described molecular weight of $1\times10^5$ is larger than 0.15%, although the anti-offset property may be satisfied, the low-temperature fixing property cannot be satisfied and also the OHP transparency cannot be said to be sufficient. Also, because in the toner 12, SF-1 does not satisfy the condition of from 130 to 160 and SF-2 does not satisfy the condition of from 110 to 140, the transferring property of the toner becomes insufficient and the deletion occurs in the inside of the solid image formed.

In the toner of Comparative Example 6, the value of the differential molecular weight distribution of the above-described molecular weight of $5\times10^3$ is not larger than 0.55%, but because the above-described molecular weight is also distributed in the range of at least $1\times10^6$, and the value of the differential molecular weight distribution of the above-described molecular weight of $1\times10^5$ is larger than 0.15, although the anti-offset property may be satisfied, the OHP transparency is insufficient and the low-temperature fixing property cannot be satisfied.

In the toner of Comparative Example 7, the value of the differential molecular weight distribution of the above-described molecular weight of $5\times10^3$ is not larger than 0.55%, but because the above-described molecular weight is also distributed in the range of at least $1\times10^6$, and the value of the differential molecular weight distribution of the above-described molecular weight of $1\times10^5$ is larger than 0.15 and also the melt viscosity of the wax is too high, although the anti-offset property may be satisfied, the OHP transparency and the low-temperature fixing property cannot be satisfied.

As described above in detail, according to the present invention, an electrostatic charge image developing toner which can form fixed image being excellent in the low-temperature fixing property, the OHP transparency and the anti-offset property, and having a high glossiness without substantially not coating oil in heat roll fixing, a two-component developer containing the toner, and an image-forming process using the toner can be provided.

The entire disclosure of Japanese Patent Application No. 2000-007221 filed on Jan. 14, 2000 including specification, claims, drawings and abstract is incorporated herein by reference in its entirety.

What is claimed is:

1. A toner for developing an electrostatic latent image comprising a binder resin, a colorant, and a wax, wherein in regard to the molecular weight by GPC of the THF dissolved components of the toner, the ratio of at least $5\times10^5$ in the integral molecular weight distribution is not higher than 1% by weight, the ratio of not higher than $3\times10^3$ in the integral molecular weight distribution is not higher than 30% by weight, and the ratio $\{W(5\times10^3)/W(1\times10^5)\}$ is from 15 to 50, wherein $\{W(5\times10^3)\}$ represents a ratio of not higher than $5\times10^3$ in the integral molecular weight distribution, and $\{W(1\times10^5)\}$ represents a ratio of at least $1\times10^5$ in the integral molecular weight distribution respectively.

2. The toner for developing an electrostatic latent image according to claim 1, wherein the binder resin comprises at least a binder resin (A) and a binder resin (B), the binder resin (A) having a weight average molecular weight (Mw) in a range from 8000 to 18000 and a ratio (Mw/Mn) of the weight average molecular weight (Mw) to a number average molecular weight (Mn) of the binder resin (A) from 2 to 4, the binder resin (B) having a weight average molecular weight (Mw) in a range from 20,000 to 40,000, and a ratio (Mw/Mn) of the weight average molecular weight (Mw) to a number average molecular weight (Mn) from 3 to 5.

3. The toner for developing an electrostatic latent image according to claim 1, wherein the wax has a melting point in a range from 70 to 100° C.

4. The toner for developing an electrostatic latent image according to claim 3, wherein the wax has a melting viscosity from 1 to 200 mPa·s at 110° C.

5. The toner for developing an electrostatic latent image according to claim 1, wherein the toner further contains inorganic fine particles in the inside thereof in an amount of from 1 to 10% by weight to the toner.

6. The toner for developing an electrostatic latent image according to claim 1, wherein the molecular weight by GPC of the THF dissolved components of the toner is distributed in the range of not larger than $1\times10^6$, the value of the differential molecular weight distribution of the molecular weight of $5\times10^3$ is not larger than 0.55%, and the value of the differential molecular weight distribution of the molecular distribution of the molecular weight of $1\times10^5$ is not larger than 0.15%.

7. A two-component developer comprising a carrier and a toner, wherein the toner is the toner described in claim 1.

8. An image forming process comprising a step of forming an electrostatic latent image on a latent image holding member, a step of forming a toner image by developing the electrostatic latent image with a toner, a step of transferring the toner image onto a transfer material to form a transfer image, and a step of fixing the transferred image using a fixing apparatus comprising a heat roller and a pressure roll, wherein the toner is the electrostatic latent developing toner described in claim 1, and wherein a surface layer of the heat roller and the pressure roller comprises a releasing resin, and a releasing liquid is not substantially supplied to the surface layer of said beat roller and said pressure roller.

9. The image forming process according to claim 8, wherein when an amount of the toner image formed on the transfer material before fixing is 0.50 mg/cm$^2$, the toner image has a glossiness after fixing (75 degree gloss) of from 40 to 60.

10. The image forming process according to claim 8, wherein, the heat roller has a surface temperature of from 150 to 180° C.

11. The image forming process according to claim 8, wherein, the heat roller and the pressure roller each have a peripheral transferring speed of from 70 to 120 mm/second.

12. The image forming process according to claim 8, wherein the heat roller and the pressure roller, have a pressing force therebetween from 392 to 638N.

13. The image forming process according to claim 8, wherein each of the heat roller and the pressure roller have an elastic layer and the surface layer on a core surface in this order.

14. A toner for developing an electrostatic latent image comprising a binder resin, a colorant, and a wax, wherein the molecular weight by GPC of the THF dissolved components of the toner is distributed in a range of not larger than $1\times10^6$, the value of the differential molecular weight distribution of the molecular weight $5\times10^3$ is not larger than 0.55%, and the value of the differential molecular weight of the molecular weight $1\times10^5$ is not larger than 0.15%.

15. The toner for developing an electrostatic latent image according to claim 14, wherein the binder resin comprises at least a binder resin (A) and a binder resin (B), the binder resin (A) having a weight average molecular weight (Mw) in a range from 8000 to 18000, and a ratio (Mw/Mn) of the weight average molecular weight (Mw) to a number average molecular weight (Mn) from 2 to 4, the binder resin (B) having a weight average molecular weight (Mw) in a range from 20,000 to 40,000, and a ratio (Mw/Mn) of the weight average molecular weight (Mw) to a number average molecular weight (Mn) from 3 to 5.

16. The toner for developing an electrostatic latent image according to claim 14, wherein the wax has a melting point in a range from 70 to 100° C.

17. The toner for developing an electrostatic latent image according to claim 14, wherein the wax has a melting viscosity of from 1 to 200 mPa·s at 100° C.

18. The toner for developing an electrostatic latent image according to claim 14, wherein the toner further contains inorganic fine particles in the inside thereof in an amount of from 1 to 10% by weight to the toner.

19. An image forming process comprising a step of forming an electrostatic latent image on a latent image holding member, a step of forming a toner image by developing the electrostatic latent image with a toner, a step of transferring the toner image onto a transfer material to form a transfer image, and a step of fixing the transferred image using a fixing apparatus comprising a heat roller and a pressure roller, wherein the toner is the electrostatic latent developing toner described in claim 7, and wherein a surface layer of the heat roller and the pressure roller comprises a releasing resin, and a releasing liquid is not substantially supplied to the surface layer of said heat roller and said pressure roller.

20. The image forming process according to claim 19, wherein when an amount of the toner image formed on the transfer material before fixing is 0.50 mg/cm$^2$, the toner image has a glossiness after fixing (75 degree gloss) of from 40 to 60.

* * * * *